US008978558B2

(12) United States Patent
Lumley

(10) Patent No.: US 8,978,558 B2
(45) Date of Patent: Mar. 17, 2015

(54) SHAPED CHARGE AND ELEMENT

(75) Inventor: Andrew Lumley, Alston (GB)

(73) Assignee: Jet Physics Limited (GB)

( * ) Notice: Subject to any disclaimer, the term of this patent is extended or adjusted under 35 U.S.C. 154(b) by 0 days.

(21) Appl. No.: 13/552,186

(22) Filed: Jul. 18, 2012

(65) Prior Publication Data

US 2013/0014663 A1 Jan. 17, 2013

Related U.S. Application Data

(63) Continuation of application No. PCT/GB2011/000061, filed on Jan. 18, 2011.

(30) Foreign Application Priority Data

Jan. 18, 2010 (GB) ..... 1000848.0

(51) Int. Cl.
*F42B 1/036* (2006.01)

(52) U.S. Cl.
CPC ..... *F42B 1/036* (2013.01)
USPC ..... 102/307; 102/309

(58) Field of Classification Search
USPC ..... 102/306, 307, 308, 309, 310, 476
See application file for complete search history.

(56) References Cited

U.S. PATENT DOCUMENTS

| | | | | |
|---|---|---|---|---|
| 2,543,057 | A * | 2/1951 | Porter | 102/307 |
| 2,587,243 | A * | 2/1952 | Sweetman | 102/307 |
| 3,165,057 | A * | 1/1965 | Armstrong | 102/307 |
| 3,185,089 | A * | 5/1965 | Parkhurst et al. | 102/307 |
| 3,374,737 | A * | 3/1968 | Pike | 102/275.5 |
| 3,855,929 | A | 12/1974 | Ridgeway | |
| 4,126,092 | A * | 11/1978 | Cross | 102/307 |
| 4,151,798 | A * | 5/1979 | Ridgeway | 89/1.14 |
| 4,181,079 | A * | 1/1980 | Klier et al. | 102/476 |
| 4,693,181 | A * | 9/1987 | Dadley et al. | 102/307 |
| 5,036,771 | A * | 8/1991 | Alford | 102/307 |
| 6,378,438 | B1 | 4/2002 | Lussier | |
| 7,536,956 | B2 * | 5/2009 | Sammons et al. | 102/476 |
| 2005/0115448 | A1 | 6/2005 | Pratt et al. | |
| 2013/0014662 | A1 * | 1/2013 | Lumley | 102/307 |

FOREIGN PATENT DOCUMENTS

| | | | |
|---|---|---|---|
| FR | 2333764 | A1 | 7/1977 |
| GB | 618617 | A | 2/1949 |
| GB | 1256255 | A | 12/1971 |

(Continued)

OTHER PUBLICATIONS

International Search Report dated Apr. 29, 2011 of PCT/GB11/000061.

(Continued)

*Primary Examiner* — James S Bergin
(74) *Attorney, Agent, or Firm* — EIP US LLP

(57) ABSTRACT

One or more aspects of the present invention relate to a shaped charge, including a linear shaped charge comprising an explosive element, a liner, a face for application to a target object and a space between the liner and the face, the liner being arranged for projection through the space, towards the face, when the explosive element is detonated, wherein the linear shaped charge comprises at least one film between the liner and the face. The invention further relates to an element for a shaped charge and a method of modifying a shaped charge.

35 Claims, 3 Drawing Sheets

(56) References Cited

FOREIGN PATENT DOCUMENTS

| | | | |
|---|---|---|---|
| GB | 2165868 | A | 4/1986 |
| GB | 2179664 | A | 3/1987 |
| GB | 2303687 | A | 2/1997 |
| WO | 2004048880 | A1 | 6/2004 |

OTHER PUBLICATIONS

GB Search Report dated May 13, 2010 of GB1000848.0.
Written Opinion dated Apr. 29, 2011 of PCT/GB11/000061.
"Blade The Cutting Edge", Royal Ordnance Industrial Energetics, Jan. 1994, 4 pages.
Vigil, "Optimized Conical Shaped Charge Design using the SCAP Code", Sandia Report, Sep. 1988, pp. 1-87.
Vigil, "Precision Linear Shaped Charge Designs for Severance of Aluminum materials", Sandia Report, Dec. 1992, 35 pages.
Technical Manual Demolition Materials, The United States Navy Sea Systems Command, Sep. 1, 1989, 4 pages.
Walters, "Introduction to Shaped Charges", Army Research Laboratory, Mar. 2007, 124 pages.
"Linear Shaped Charge", Space-Ordnance Division, Ensign Bickford, Jun. 1967, 40 pages.
Ashton, "Navy Experimental Diving Unit Report 15-90", United States Department of the Navy, May 1990, 25 pages.

* cited by examiner

SHAPED CHARGE AND ELEMENT

CROSS-REFERENCE TO RELATED APPLICATIONS

This application is a Continuation of PCT/GB2011/000061, filed Jan. 18, 2011, which is an international application claiming priority to Great Britain App. No. 1000848.0, filed Jan. 18, 2010. The entire contents of which are incorporated herein by reference in their entirety.

FIELD OF THE INVENTION

The present invention relates to a shaped charge, particularly but not exclusively to a linear shaped charge, an element for a shaped charge and a method of modifying a shaped charge.

BACKGROUND OF THE INVENTION

A linear cutting charge is an explosive device for cutting a target object. A type of linear cutting charge is termed a linear shaped charge. Linear shaped charges are known from the prior art, for example from U.S. Pat. No. 4,693,181, and the product commercially known as "Blade" generic charge, demolition, linear, cutting/flexible, lightweight (CDLC/FL). In use, a linear shaped charge is applied to a target object for cutting. Upon detonation of an explosive element in the charge, a metal liner forms a metal slug which is projected as a cutting jet towards the target object. The cutting jet is linear, along a longitudinal axis of the charge, and therefore cuts the target object along a line defined by a configuration of the charge when applied to the target object. This may be a curved linear configuration. The shape and depth of the cut may be finely controlled, by selecting appropriate dimensions and explosive loadings in the charge. Accordingly, linear shaped charges have many and varied applications, both civil and military, where a clean and controlled cut is required. Given the high cutting power, linear shaped charges may be used to cut concrete or metallic structures, for example when breaching walls or demolishing building structures. The precision of the line and depth of the cut allows for delicate cutting operations, for example cutting of a bomb casing.

It is often desirable to use linear shaped charges underwater, for example to cut a structure underwater, for example a structural support or a hull of a boat. Presently, for operating a linear shaped charge underwater, a rigid vessel is used which encloses the linear shaped charge when applied to the target object, and reduces water penetration in, and the effect of underwater pressures on, the linear shaped charge. Such a method is awkward and problematic. The vessel is rigid, and therefore a target object may only be cut along a straight line or a line according with the shape of the vessel. Moreover, ends of the vessel, perpendicular the longitudinal axis of the linear shaped charge, enclose ends of the charge and therefore prevent cutting where the ends of the vessel contact the target object. Further, the vessel is ineffective at deeper common diving depths, for example at a depth of 15 meters from the surface, not least as it is bulky and awkward to manipulate, and the cutting charge has to expend energy cutting through a wall of the vessel between the charge and the target. Consequently, water penetration and pressure effects prevent satisfactory performance of the linear shaped charge.

It is an object of the present invention to overcome such disadvantages.

SUMMARY OF THE INVENTION

In accordance with the present invention, there is provided a linear shaped charge comprising an explosive element, a liner, a face for application to a target object and a space between the liner and the face, the liner being arranged for projection through the space, towards the face, when the explosive element is detonated, wherein the linear shaped charge comprises at least one film between the liner and the face.

The insight of the inventor lies in placing the film between the liner and the face. It is understood in the art that the space between the liner and the face should be free of material so as not to interfere with a trajectory and efficiency of a cutting jet produced by the liner when the explosive element is detonated. It is known in the art to fill the space with a filling material, however this material needs careful selection to avoid interfering with the cutting jet to an extent which impairs cutting efficiency of the target object by the jet. It is therefore surprising that providing the film between the liner and the face nonetheless allows a jet to be produced with a suitable cutting ability for the target object.

Providing the film increases the degrees of freedom available for designing a linear shaped charge with desired properties and functionality. For example, the film may provide structural support to the liner and/or the linear shaped charge, and/or may protect the liner from pressure deformation and water contamination when the linear shaped charged is submerged in water. Alternatively, for example, the at least one film may be positioned in a plane of the face; this may therefore prevent water from entering the space and therefore obstructing the cutting jet, when the charge is used underwater for example. Water has a density of 1,000 kg $m^{-3}$ which severely disrupts the cutting jet. Thus, in accordance with examples of the present invention described already, and below, a linear shaped charge may be rendered operable underwater in a simple and effective matter.

In some embodiments of the present invention, the linear shaped charge comprises a casing surrounding at least part of the explosive element. In further embodiments, the casing may be arranged to determine a distance between the liner and the face, the casing having at least one part for application to the target object. The casing is described in further detail below.

In other embodiments, at least part of the space is filled with a filling material. The filling material may be arranged to fill substantially all of the space; the term substantially in this context means that more than 50% of the space is filled by the filling material.

In further embodiments of the present invention, a first film of the at least one film is arranged between the liner and the filling material. In this way, the properties of the at least one film can be applied to the region between the liner and the filling material. In further embodiments, the first film lies in contact with the liner and optionally the filling material. This provides energy coupling from the explosive element when detonated, by way of the cutting jet, through the first film and the filling material, particularly when the first film lies in contact with both the liner and the filling material, as a space between the liner and the first film may otherwise reduce efficiency of the cutting jet.

Moreover, with the first film provided between the liner and the filling material, for example in contact with the liner and the filling material, the first film provides stiffness to a perimeter of the filling material adjacent the liner. Therefore, when subjected to increased pressure, for example underwater, a tendency of the filling material to compress and thus withdraw from contacting the liner, is reduced by the added stiffness given by the first film. Otherwise, without the first film between the liner and the filling material, compression of the filling material would form a void between the liner and the filling material which, in an underwater situation, would fill with water, thus introducing water in the space between the liner and the face and interfering with jet production upon detonation; providing a film of the at least one film between the liner and the filling material overcomes this problem and gives improved underwater operation of a linear shaped charge.

In other embodiments of the present invention, a second film of the at least one film is arranged between the face and the filling material. Accordingly, the properties of the at least one film can be applied to the region between the filling material and the face, thus reducing ingress of water into the space and therefore improving the performance of the jet upon detonation. In further embodiments, the second film lies in contact with the face and optionally the filling material. This provides energy coupling from the explosive element when detonated, by way of the cutting jet, from the liner to the face and thus to the target object applied to the face; particularly when the second film lies in contact with the filling material and the face, as a space between the face and the second film may otherwise reduce efficiency of the cutting jet.

In an embodiment, the first film lies in contact with the liner and the filling material and the second film lies in contact with the filling material and the face. Accordingly, energy coupling is obtained from the explosive element through to the target object at the face. In this way, the cutting jet is efficient in penetrating the target object. Moreover, advantages in terms of underwater performance are provided.

In embodiments of the invention, longitudinal surfaces of the filling material are coated with a film, thus forming the at least one film. A longitudinal surface of the invention is a surface having a dimension parallel a longitudinal axis LA of the linear shaped charge. All longitudinal surfaces of the filling material may be coated with a film in accordance with the invention, thus forming a continuous film around the filling material, excluding end cross sections perpendicular the longitudinal axis LA. This continuous film includes the first film and the second film of the at least one film. Applying a continuous film is a simple method of applying the film compound to the outside of the filling material. The properties of the continuous film may therefore apply uniformly around the filling material along the longitudinal axis LA, sealing the filling material longitudinally, for example from water ingress into the filling material and therefore the space.

In further embodiments of the present invention, at least part of the casing is coated with a further film. The further film may have the same or similar properties as the at least one film described above. Thus, the properties of the at least one film may be applied also to at least part of the casing. In some embodiments, longitudinal surfaces of the casing are coated with the further film. Similarly as for the filling material, a continuous further film may be applied around the casing, thus applying the further film in a simple manner. The further film may therefore apply its properties uniformly to the casing along the longitudinal axis LA, sealing the casing longitudinally.

In other embodiments of the invention, the filling material is fixed to the casing by fixing part of the at least one film to part of the further film. In this way any gap between the filling material and the casing may be sealed, for example by adhesive used for the fixing. This can provide further properties to the charge, for example increased waterproofing and resistance to underwater pressures.

In alternative embodiments, the casing and the filling material are integrally formed. Longitudinal surfaces of the integral casing and filling material may in some embodiments be coated with a film, thus forming the at least one film and the further film. In this way, the film coating may be applied across all longitudinal surfaces of the integral casing and filling material, for example as a continuous film, thus providing the properties of the film to all longitudinal surfaces of the integral casing and filling material.

In some embodiments, the explosive element and the liner have a V-shaped cross section, the liner lying in a groove of the V-shaped cross section of the explosive element. Such shaping facilitates an efficient cutting jet when the explosive element is detonated.

In further embodiments of the present invention, the at least one film and/or the further film comprise a compound comprising bitumen and a surfactant. Such a compound is easy to apply as a paint, for example to the casing and/or filling material. Moreover, this compound when dry provides structural rigidity in the at least one film and/or further film. This reduces deformation of the linear shaped charge at underwater pressures, especially to the liner and/or filling material, using the first film and/or second film. Further, the compound acts as a barrier against water, therefore allowing the at least one film and/or the further film to shield or protect the casing and/or filling material, and/or the liner, from water, especially when the charge is submerged underwater. Moreover, the compound may flex without breaking, thus maintaining a continuous at least one film, and/or further film, whilst allowing flexibility of the charge.

In other embodiments, the casing and/or filling material has a density in the range of 15 to 60 kg $m^{-3}$, 25 to 60 kg $m^{-3}$, 35 to 60 kg $m^{-3}$, 45 to 60 kg $m^{-3}$, 50 to 60 kg $m^{-3}$ or 55 to 60 kg $m^{-3}$. Filling material of these densities does not interfere with the efficiency of the cutting jet to the extent that cutting performance of the target object is impaired. Moreover, such densities provide sufficient structural support and rigidity to the casing and/or filling material, especially at a density of 45 kg $m^{-3}$ and above.

In some embodiments of the invention, the casing and/or filling material comprises a low density polyethylene foam (LDPE). This provides the required properties for the casing and/or filling. The LDPE, or an alternative foam, provides open cells of the foam structure at external surfaces of the casing and/or filling material. For embodiments where the at least one film comprises the compound comprising bitumen and a surfactant, the compound fills and interacts with these open cells when the film is applied, assisted by the surfactant, meaning that when dried the compound forms a fixed engagement with the LDPE. This gives adhesion of the compound to the LDPE, and contributes to structural support provided by the compound. Moreover, this interaction with open cells allows a uniform coating of the compound to be applied to the casing and/or filling material.

Further, the linear shaped charge is flexible along a longitudinal axis. This allows the target object to be cut with a curved shape. Flexible means the linear shaped charge may be changed between different configurations, i.e. the charge is not rigid, and may be non-resilient, meaning the charge does not restore itself to a previous configuration.

In further embodiments, the at least one film is arranged for operating the linear shaped charge underwater. The at least one film may therefore act as a suitable waterproof barrier and support for resisting deformation of the charge by underwater pressures. In some embodiments, the at least one film is arranged for operating the linear shaped charge at a depth underwater of up to 5 meters, 10 meters, 15 meters or 20 meters from the water surface. Such underwater depths are common diving depths. The present invention therefore facilitates a linear shaped charge which is operable at all common diving depths, providing versatility to underwater cutting operations undertaken by divers. The linear shaped charge of the present invention therefore has intrinsic properties against adverse effects of underwater pressures and water penetration into the charge; an external vessel for surrounding the charge underwater may therefore be eliminated. This reduces a load carried by a diver for underwater cutting, and makes applying the charge to the target object and operating the charge simple and easy to perform.

According to a second aspect of the invention, there is provided an element for a shaped charge, the shaped charge comprising an explosive element, a liner, a face for application to a target object and a space between the liner and the face, the liner being arranged for projection through the space, towards the face, when the explosive is detonated, wherein the element comprises a support member and a film supported by the support member, the element being arranged for application to the shaped charge to provide at least one film between the liner and the face. Thus, a shaped charge may be retrofitted with the element, to provide the charge with at least one film between the liner and the face and therefore advantages of the present invention.

In further embodiments, the element has a shape for engaging with a surface of the liner, thus allowing the element to fit closely with a form of the shaped charge. The element may be arranged to fill substantially all of the space, thus reducing or preventing water entering the space of the shaped charge and improving the underwater performance of the shaped charge.

According to a further aspect of the present invention, there is provided a method of modifying a shaped charge, the shaped charge comprising an explosive element, a liner, a face for application to a target object and a space between the liner and the face, the liner being arranged for projection through the space, towards the face, when the explosive is detonated, the method including providing at least one film between the liner and the face. In such a method, the shaped charge may be provided with the element of the second aspect of the invention described above, to give the shaped charge advantages of the present invention.

In a further aspect of the present invention, there is provided a shaped charge comprising an explosive element, a liner, a face for application to a target object and a space between the liner and the face, the liner being arranged for projection through the space, towards the face, when the explosive element is detonated, wherein the shaped charge comprises at least one film between the liner and the face. Thus, providing of at least one film between the liner and the face is not limited to linear shaped charges; at least one film may be provided between the liner and face of other shaped charges, for example conical, parabolic, hemispherical and progressive shaped charges, providing such charges with advantages of the present invention.

In further embodiments of the linear shaped charge, element, method, and shaped charge of the invention, the at least one film may comprise granules selected from the group consisting of: mineral granules, granules with an average diameter of 0.1 milli-meters, calcium carbonate granules, and combinations thereof. As explained in further detail below, the granules provide increased stiffness to the at least one film in increased pressure situations, thus improving the underwater performance of shaped charges at greater depths.

Further features of the invention will become apparent from the following description of embodiments of the invention, given by way of example only, which is made with reference to the accompanying drawings.

DETAILED DESCRIPTION OF THE INVENTION

Figure 1:
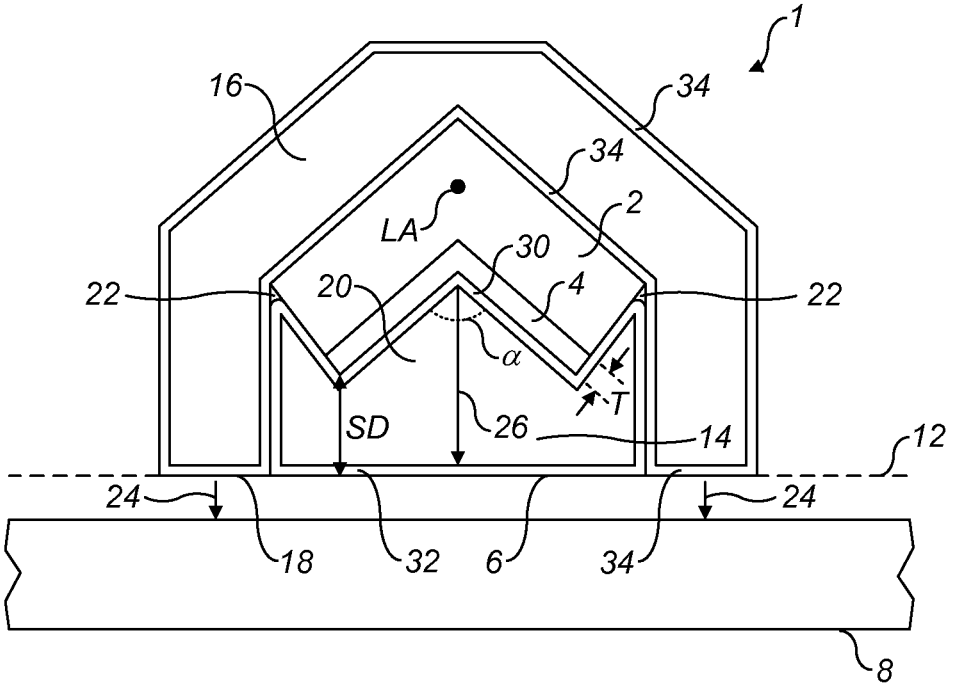
FIG. 1 shows schematically a cross section of an embodiment of the present invention.
Figure 2:
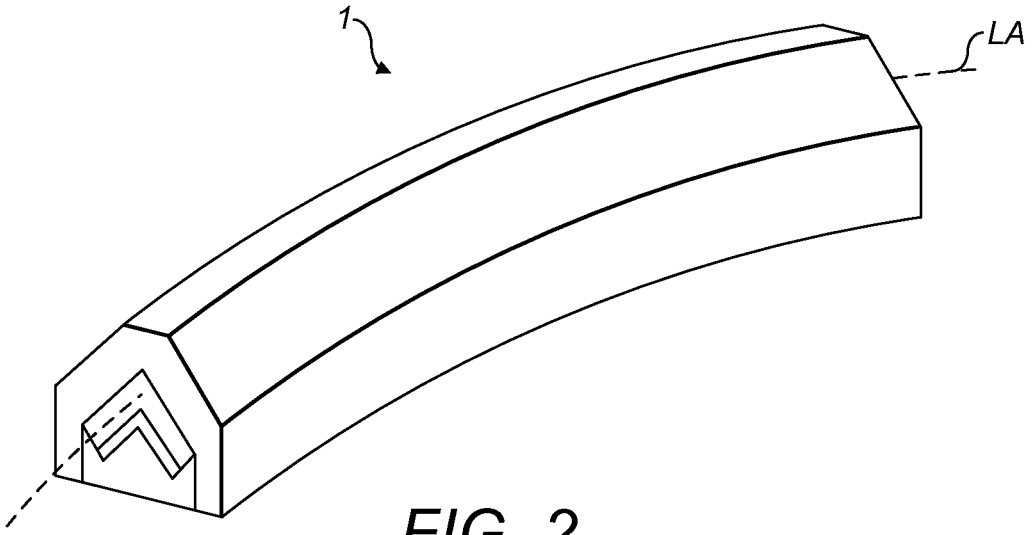
FIG. 2 shows schematically a perspective view of an embodiment of the present invention.

FIG. 1 shows schematically a cross section of a linear shaped charge 1 according to an embodiment of the present invention. FIG. 2 shows schematically a perspective view of the linear shaped charge 1 of this embodiment.

Referring to FIG. 1, the linear shaped charge comprises an explosive element 2, a liner 4, and a face 6 for application to a target object 8. The explosive element and the liner have a V-shaped cross section, taken in a plane perpendicular a longitudinal axis LA of the charge 1, as illustrated in FIG. 1. The liner lies in a groove of the V shaped cross section of the explosive element. The explosive element and the liner are formed of materials which adhere to each other upon contact, without requiring a separate adhesive. The face 6 is planar, defining a target plane 12. There is a space 14 between the liner 4 and the face 6. The linear shaped charge 1 comprises at least one film between the liner and the face. The term film in the context of the present invention may be a skin, a coating, a sheath, or a covering layer, for example.

In this embodiment, a casing 16 surrounds at least part of the explosive element 2. The casing 16 provides structural support to the charge 1, including to the explosive element and the liner during bending of the charge. The casing 16 also protects the explosive element and the liner from environmental factors such as rain, water vapour, and from being damaged if dropped or knocked.

The casing has a V-shaped surface which receives the explosive element 2 on a side opposite the side of the explosive element adhered to the liner 4. The casing 16 is arranged to determine a distance between the liner and the face, for example in this embodiment the casing 16 extends beyond a point of the liner nearest the face to define two longitudinal surfaces 18, parallel the longitudinal axis LA, lying in the plane 12 of the face 6. Thus, the casing has at least one part for application to the target object.

The liner is arranged for projection through the space, towards the face, when the explosive element is detonated. The extent of the casing 16 beyond the liner defines a stand-off distance SD between the extent of the liner nearest the face 6 and the plane 12 of the face 6. The stand-off distance SD is selected in accordance with dimensions of other components of the charge, for example a thickness T of the liner 4, an apex angle $\alpha$ of the liner 4. Thus, a form and cutting ability of a cutting jet formed by the liner when projected towards the face on detonating the explosive element 2 may be controlled.

The shape and volume of the space 14 is determined by the geometry of the explosive element 2, the liner 4 and the casing 16. A filling material 20 may fill substantially all of the space 14. The term substantially in this context means that more than 50% of the space is filled by the filling material. In the present embodiment all of the space is filled with the filling material, except for voids 22 formed to avoid feathering of edges of the filling material when being shaped, and the part of the space occupied by at least one film described further below. In other embodiments, greater than 75%, or greater than 90% of the space may be filled by the filling material. In another embodiment, 100% of the space is filled by the filling material except for part of the space occupied by the at least one film. In alternative embodiments, at least part of the space may be filled with the filling material, for example less than 50% of the space. The filling material has a density of between 15 kg $m^{-3}$ and 60 kg $m^{-3}$, 25 to 60 kg $m^{-3}$, 35 to 60 kg $m^{-3}$, 45 to 60 kg $m^{-3}$, 50 to 60 kg $m^{-3}$ or 55 to 60 kg $m^{-3}$; greater than 60 kg $m^{-3}$ may obstruct the jet to an extent of decreasing the penetration of the cut into the target object. In other embodiments, the space may be empty; i.e. not filled.

In the present embodiment, a first film 30 of the at least one film is arranged between the liner and the filling material. The first film lies in contact with the liner and the filling material. In alternative embodiments, where the space is occupied by less of the filling material, the first film may not lie in contact with the liner and/or filling material.

Further, in the present embodiment, a second film 32 of the at least one film is arranged between the face and the filling material. The second film lies in contact with the face and the filling material. In alternative embodiments, where the space is occupied by less of the filling material, the second film may not lie in contact with the face and/or filling material.

In the present embodiment, longitudinal surfaces of the filling material are coated with a film, including the first and second films, thus forming the at least one film. In this example, the at least one film is a continuous film applied around the longitudinal surfaces of the filling material. A cross sectional end of the charge 1 may also be coated with a film according to the present invention, although it is to be appreciated that cutting the charge to size may remove this end film. An end of the charge could be coated with a film of the invention after cutting, to maintain a continuous film around the filling material.

At least part of the casing is coated with a further film 34. The further film may be the same composition as the film applied on the filling material. In this embodiment, the further film coats longitudinal surfaces of the casing, thus in this example forming a continuous film applied around all longitudinal surfaces of the casing. Similarly as for the filling material, a cross sectional end of the charge 1 may also be coated with a film according to the present invention, to maintain a continuous film around the casing.

In this embodiment, the filling material is fixed to the casing by fixing part of the at least one film to part of the further film. Alternatively, a part of the casing may be fixed to a part of the filling material, without film being in between. Such fixing may be achieved using an adhesive between adjacent parts of the film of the casing and the film of the filling material. In alternative embodiments, the casing and the filling may be integrally formed and coated with a film including the at least one film of the invention, which may form a continuous film on all longitudinal surfaces around the exterior and interior of the integral casing and filling material.

In such embodiments with the casing and filling material fixed together, the casing and filling material press the explosive element against the casing and the liner against the filling material with sufficient pressure to fix the explosive element and liner in place in the charge 1. In alternative embodiments, with or without the filling material, the explosive element may be fixed to the casing, or to the further film of the casing, with adhesive.

The filling material may not extend beyond the plane 12 of the face 6. In some embodiments, the filling material may have a face lying in the plane 12 of the face 6 of the charge, for application to the target object 8. Alternatively, the second film may have a face lying in the plane 12 of the face 6 of the charge. The face of the charge 6 may comprise an adhesive layer (not shown) for adhering the charge 1 to the target object 8.

In use, the face 6 of the charge is applied to the target object 8, as indicated by arrows 24. The charge may be adhered or otherwise held in position on the target object. The charge 1 may be flexible along the longitudinal axis LA, by choosing appropriate materials of the component parts of the charge. The flexibility means the charge may be applied in a curved configuration on the target object, for example with the face 6 of the charge on a planar surface of the target object, or with the face 6 following contours of a non-planar surface of the target object.

Once the charge 1 is applied to the target object, the explosive element 2 is detonated, using for example an electrical detonator. Upon detonation, the liner 4 is projected towards the target object 8 as a jet 26 originating from the apex of the liner 4. The jet 26 penetrates the target object along the length of the charge, thus cutting the target object 8.

The target object 8 illustrated in FIG. 1 is an example. A linear shaped charge according to the present invention may be used to cut many different objects, of various shapes with varying complexity, and formed of numerous different materials, organic and inorganic, for example metal, concrete, mineral, or plastic.

Examples of materials of components of a linear shaped charge described above in accordance with the invention will now be described.

The explosive element 2 comprises for example a mixture of 88% by weight of RDX (cyclotrimethylenetrinitramine), 8.4% by weight PIB (polyisobutylene), 2.4% by weight DEHS (2 (Diethylhexyl) sebacate), and 1.2% by weight PTFE (polytetrafluoroethylene), the % by weight being a percentage of the weight of the explosive element. Alternatively, the explosive element may comprise SX2/Demex Plastic Explosive from BAE Systems, Glascoed, USK, Monmouthshire NP15 1XL, UK, or Primasheet 2000 Plastic Explosive from Ensign-Bickford Aerospace & Defense Company, Simsbury, Conn. 06070 USA.

The liner may comprise a mixture of 85 wt % of 300 mesh copper particles, 5.6 wt % polyisobutylene, 2.4 wt % 2(diethylhexyl) sebacate) (DEHS) and 7.0 wt % polytetrafluoroethylene (PTFE) as is known in the art. The term wt % means weight percentage of the total weight of the mixture.

Alternatively, the liner may comprise a material comprising copper particles dispersed in a polymer matrix. Alternatively, the particles may comprise at least one metal selected from the group consisting of: copper (Cu), tungsten (W), molybdenum (Mo), aluminium (Al), uranium (U), tantalum (Ta), lead (Pb), tin (Sn), cadmium (Cd), cobalt (Co), magnesium (Mg), titanium (Ti), zinc (Zn), zirconium (Zr), beryllium (Be), nickel (Ni), silver (Ag), gold (Au), platinum (Pt), and/or an alloy thereof. The particles may be substantially spherical. The term substantially spherical means the average shape of the particles is spherical. The particles are packed in the polymer matrix with a density of at least 0.625, 0.650, 0.675, or 0.700 of the density of the Cu. The packing corresponds with the Kepler Conjecture on packing. The particles may be substantially uniformly dispersed in the polymer matrix, with neighbouring particles being separated from each other by polymer. Substantially uniformly means that a mean separation distance between neighbouring particles in a first volume, and in a different second volume of the material, are equal. The material has a density of greater than 5,000, 5,100, 5,200, 5,300, 5,400, 5,500, 5,600, 5,700, or substantially 5,800 kg $m^{-3}$. Substantially 5,800 kg $m^{-3}$ means the mean density of the material throughout its volume is 5,800 kg $m^{-3}$. The particles may comprise particles with different diameters, for example, specifically: 0.5 to 1 wt % particles with a diameter of 70 micro-meters; 4 to 5 wt % particles with a diameter of 60 micro-meters; 20 to 30 wt % particles with a diameter of 50 micro-meters; 25 to 35 wt % particles with a diameter of 40 micro-meters; 20 to 30 wt % particles with a diameter of 10 micro-meters; and less than 3 wt % particles with a diameter of less than 10 micro-meters. The term wt % used for the ranges of particle size refers to a percentage weight of the total mass of particles in the material. In an example where the particles are of copper and have the ranges of different diameters described above, the copper particles are 88 wt % of the total weight of the material. The copper particles are obtainable from ECKA Granulate GmbH & Co. KG, Frankenstraβe 12 D-90762 Fürth, Germany.

The polymer matrix of the material comprises polyisobutylene (PIB) or polybutene (PB) which is 4.5 wt % of the total weight of the material. The PIB is for example Oppanol® B10, B12, B15 or B30 supplied by BASF, Ludwigshafen, OH 67063, Germany. The polymer matrix further comprises boron nitride, or a polytetrafluoroethylene dry lubricant, which is 4.5 wt % of the total weight of the material. Such a dry lubricant is obtainable as h-BN from Goodfellow Limited, Huntingdon, Cambridgeshire PE29 6WR, UK or Fluon® FL1690 or FL1710 from AGC Chemicals Europe, Ltd, Thornton Cleveleys, Lancashire FY5 4QD, UK.

Further, the polymer matrix comprises cyanuric acid or melamine, or polytetrafluoroethylene filler (including environmentally friendly "E" grades) which is 1.5 wt % of the total weight of the material. Cyanuric acid and melamine are obtainable from Monsanto UK Limited, Cambridge CB1 0LD, UK and ICI Akzo Nobel Powder Coatings Ltd., Gateshead, Tyne & Wear NE10 0JY, UK. Polytetrafluoroethylene filler is obtainable as CD123, CD127 or CD141 from Asahi Glass AGC Chemicals Europe Limited, Thornton Cleveleys, Lancashire FY5 4QD, UK.

Di-2-ethylhexyl sebacate (dioctyl sebacate—DOS) or di-n-octyl phthalate (DOP) plasticizer/wet lubricant is also added, as 1.5 wt % of the total weight of the material. Either may be obtained from Brad-Chem Ltd, Moss Ind. Estate. Leigh, Lancashire WN7 3PT, UK. Vegetable and other synthetic oil lubricants of diester type can be substituted as a plasticizer.

The material of this embodiment may be made in accordance with one of the following two methods:

In the first method, which yields approximately 10 kg material, is a two-phase system is used consisting of an aqueous liquid phase and a second liquid phase which comprises an organic solvent that is insoluble in water carrying the polyisobutene binder. The polyisobutene binder is dissolved in a solvent of toluene to prepare a solution, which then is injected into the metal powder and filler and dry lubricant mix dispersed in water. A granular product is formed from the obtained mixture; this is then distilled to isolate the bulk polymer. This polymer may be calandered and slit to produce the required sectional dimensions for a liner of a linear shaped charge.

Specific process steps are now explained:

i) 8.80 kg of the copper particles with the different diameters described above and 0.60 kg filler and dry lubricant mixture (0.45 kg h-BN, FL1690 or FL1710 dry lubricant and 0.15 kg cyanuric acid, melamine, CD123, CD127 or CD141 dispersion filler) are put into a glass bead mill with stirrer and a capacity of approx. 20 liters.

ii) After stirring for 20 minutes at room temperature, the mix is deagglomerated and thoroughly wetted by the water. The suspension is then flushed out of the mill, separated from the glass beads and put into an agitator vessel.

iii) With moderate stirring, a solution of 0.45 kg of polyisobutene (BASF Oppanol B10, B12, B15 or B30) in a solvent mixture of 5 liters of toluene is then injected in the course of 20 minutes at room temperature into the wetted mix at ii) above.

iv) The rate of stirring is so controlled that spherical granulate consisting of metal, filler, dry lubricant and solvent is obtained after stirring has been continued for 20 minutes at room temperature.

v) The granulate is separated from the water by suction filtration without mechanical action on the filter product. The filtration proceeds very easily on account of the solvent still present in the granulate. The granulate is subsequently freed from solvent by distillation and dried in a vacuum cabinet at 60° C.

vi) Calandering and Slitting follows using a stainless steel two roll calander. The bulk polymer is passed through up to six times, reducing the nip by 5% on each pass to reduce the sectional thickness and increase density until material with the required sectional dimensions for the liner is produced.

The addition of 0.15 kg of plasticizer/wet lubricant: Di-2-ethylhexyl sebacate (dioctyl sebacate—DOS) or di-n-octyl phthalate (DOP), or vegetable oil may be required during the calandering pre-mixing stage.

In the second method which yields approximately 10 kg material, the copper particles having the quantities of different diameters described above for this embodiment are mixed with the dry lubricant and dispersing filler with binder and plasticizer in a high shear mixer apparatus, then the resultant bulk polymer so produced is milled and calendared and slit to the required sectional dimensions for liner.

Specific process steps are now described:

i) Charge the mixer with 0.45 kg polyisobutene (BASF Oppanol B10, B12, B15 or B30) and 0.60 kg filler and dry lubricant mixture (0.45 kg h-BN, FL1690 or FL1710 dry lubricant and 0.15 kg cyanuric acid, melamine, CD123, CD127 or CD141 dispersion filler) and masticate until the mixture has visually blended. This should take 2 minutes with a maximum frictional heat of 90 degrees Centigrade in the mixer.

ii) Add 8.80 kg of the copper particles with different diameters described above and 0.15 kg of the plasticizer/wet lubricant: Di-2-ethylhexyl sebacate (dioctyl sebacate—DOS) or di-n-octyl phthalate (DOP), or vegetable oil, and mix for a further 20 minutes.

iii) Slugs of material are made from four to five batches, by passing bulk polymer batches through a two roll mill up to four times. The colour of the batches to be mixed together into a slug should be comparable so that no streaking occurs.

iv) Calandering and Slitting follows using a stainless steel two roll calander. The bulk polymer is passed through up to six times, reducing the nip by 5% on each pass to reduce the sectional thickness and increase density until material with the required sectional dimensions for liner is produced.

The casing and/or the filling material comprise, for example, low density polyethylene foam, obtainable as Plastazote® from Zotefoams pic, 675 Mitcham Road, Croydon, Surrey CR9 3AL, Great Britain. The casing and/or the filling material may have a density in the range of 15 to 60 kg $m^{-3}$, 25 to 60 kg $m^{-3}$, 35 to 60 kg $m^{-3}$, and may be between 45 to 60 kg $m^{-3}$, 50 to 60 kg $m^{-3}$ or 55 to 60 kg $m^{-3}$ to give more structural support to the charge.

The casing and the filling material may be adhered to each other using for example 3M® Impact Vinyl Adhesive 1099 obtainable from 3M UK PLC, Jackson Street, Manchester M15 4PA, UK. The linear shaped charge may be attached to the target object using the adhesive, namely 3M® Impact Vinyl Adhesive 1099 from 3M UK PLC, Jackson Street, Manchester M15 4PA, UK.

The at least one film of the present invention, including the first and second films, and/or the further film on the casing, may comprise a compound comprising latex spray coating, for example Rockbond RB PL™, which comprises a sub-micrometer particle emulsion in a water base (and is obtainable from Rockbond SCP Ltd, Nayland, Suffolk CO6 4LX, UK), or High Build™, which comprises a complex mixture of bitumens, anionic surfactants, water and a polymer dispersion (and is obtainable from Liquid Rubber Industries, Toronto, Ontario, M5R 1G4, Canada), or an elastomeric membrane, for example EMA urethane polymer, which provides a high-build film and has a longer life than bitumen (and is obtainable from Isothane Limited, Accrington, Lancashire BB5 6NT, UK). Such compounds have a low enough viscosity for easy application to the casing and/or filling material, and for filling open cells at exterior surfaces of the casing/filling material foam. Further, when dried and cured, the compound is compatible with explosive compounds.

The linear shaped charge may be manufactured by extruding the explosive element and the liner from the appropriate material. The casing and filling material may be manufactured by a suitable cutting or grinding process. The casing and/or the filling material is coated with a film according to the present invention. Where the film is formulated of one of the example compositions described above, the film may be applied to the casing and/or filling material by immersion, brush painting or spraying, followed by drying and heat curing. Applying the film to the filling material may be conducted in a low pressure chamber, or autoclave, for example, to increase temporarily the diameter of the cells to accept the film more easily. Upon returning to atmospheric pressure the diameter of the cells decreases, giving the film a better mechanical attachment to the filling material after the film has dried/cured. The explosive element, liner, casing and filling material may then be assembled to form the charge, including adhering the casing to the filling material, in some embodiments by adhering the further film of the casing to the film of the filing material.

In some embodiments of a linear shaped charge described in accordance with FIGS. 1 and 2, with the at least one film and further film formulated for example of one of the film compositions described above, the film may be applied with a thickness of 1 milli-meter, which in some embodiments is twice the cell internal diameter of the LDPE of the casing and/or filling material. At this thickness, the film provides structural support to the adjacent liner, and to the casing and/or filling material. This structural support resists deformation of the liner, the casing and/or the filling material, and charge due to underwater pressures. Further, the film acts as a barrier to water, at least at common diving depths up to 5 meters, 10 meters, 15 meters or 20 meters below the water surface; thus the liner remains dry and also the space does not fill with water which would otherwise severely disrupt the jet. Moreover, the film is buoyant, aiding handling of the charge underwater.

Accordingly, the at least one film is arranged for operating the linear shaped charge underwater, without any detrimental reduction in cutting performance. To avoid underwater contamination via cross-sectional ends of the charge, which are not coated with the film, the charge may be cut longer than required, so the excess length of charge becomes contaminated with water first, thus delaying water contamination of the charge for the desired cutting.

The above embodiments are to be understood as illustrative examples of the invention. Further embodiments of the invention are envisaged. In the embodiments described above, the explosive element, the liner, the casing and the filling material may be formed of different materials from those described above. Further, the configuration of the charge, the liner, explosive element, casing and filling material may be different from those described above and illustrated in the Figures. For example, the embodiment described with reference to FIGS. 1 and 2 illustrates the casing and the filling material. Alternative embodiments are envisaged without the casing and/or the filling material, and also where the space may be filled by a different amount of filling material from that described.

Figure 3:
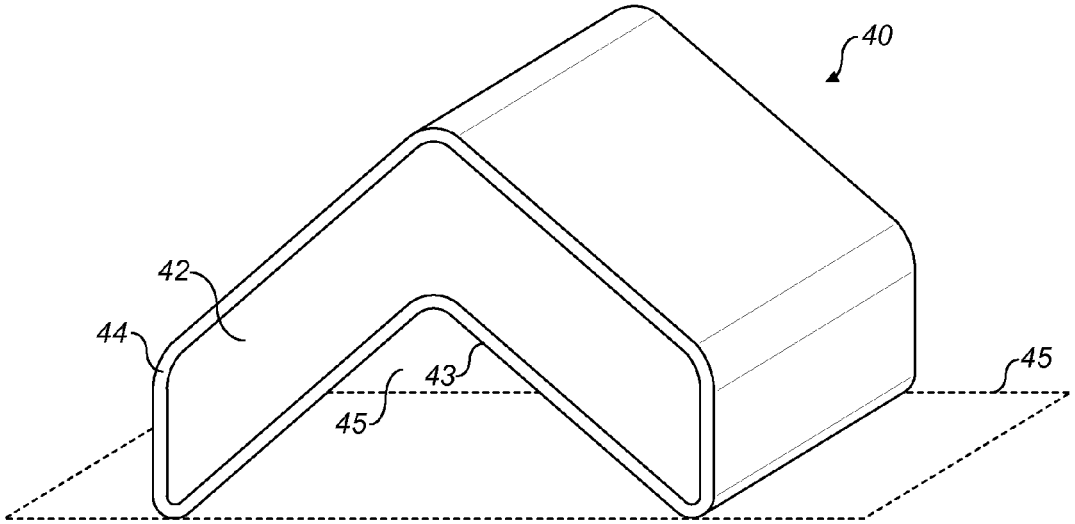
FIG. 3 (PRIOR ART)
FIG. 3 shows schematically a prior art linear shaped charge.

Further embodiments according to the present invention are envisaged for providing at least one film between the liner and the face of a known shaped charge. FIG. 3 shows an example of a prior art linear shaped charge 40, namely a linear shaped charge supplied by Accurate Energetic Systems, LLC, 5891 Highway 230 West, McEwen, Tenn. 37101, USA.

Referring to FIG. 3, the prior art linear shaped charge 40 comprises an explosive element 42, which in this example is V-shaped and surrounded by a copper layer 44. The charge has a face defining a target plane 45, for application to a target object. The inside surface 43 of the V-shaped copper layer 44 acts as a liner for forming a jet upon detonation of the explosive element 42 for projection through a space 45 between the liner and the face, towards the face.

Figure 4:
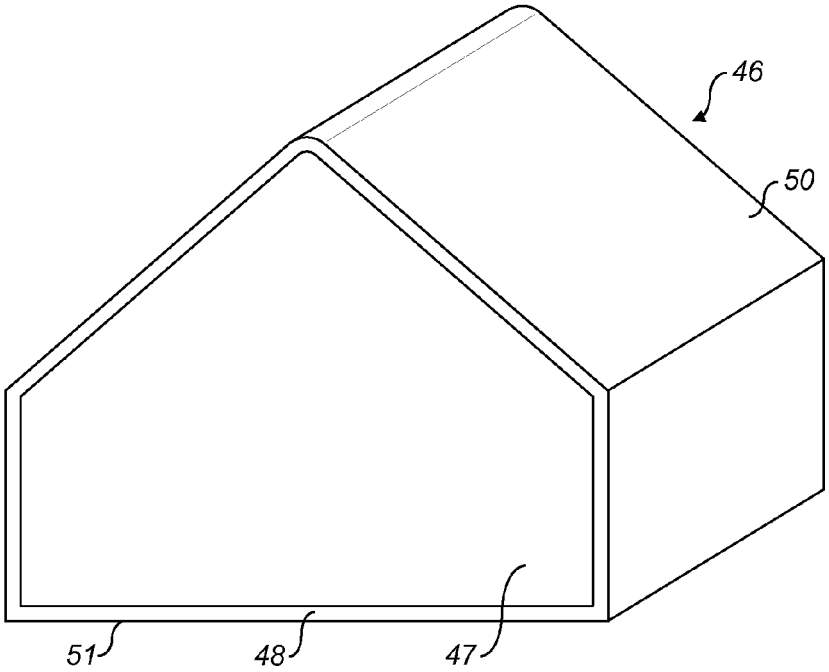
FIG. 4 shows schematically an element according to an embodiment of the present invention.

FIG. 4 illustrates schematically a further embodiment of the present invention, namely an element 46 for a shaped charge, for example the linear shaped charge of FIG. 3. The element 46 comprises a support member 47 and a film 48 supported by the support member 47. In this case the film 48 forms a continuous coating around the longitudinal surfaces of the support member, in a similar way that the longitudinal surfaces of the filling material 20 described above are coated with a film. The support member 47 may be formed for example of the filling material described previously, and the film 48 may comprise for example the film compound described previously with reference to FIG. 1 for example.

The element 46 is arranged for application to the linear shaped charge 40 to provide the at least one film between the liner and the face of the charge 40. Accordingly, the element has a shape for engaging with a surface of the liner; in this example, the element 46 has a V-shaped surface 50 for engaging with the V-shaped surface 43 of the liner of the shaped charge 40. The element 46 further has a surface 51, different from the V-shaped surface, for application to a target object.

Figure 5:
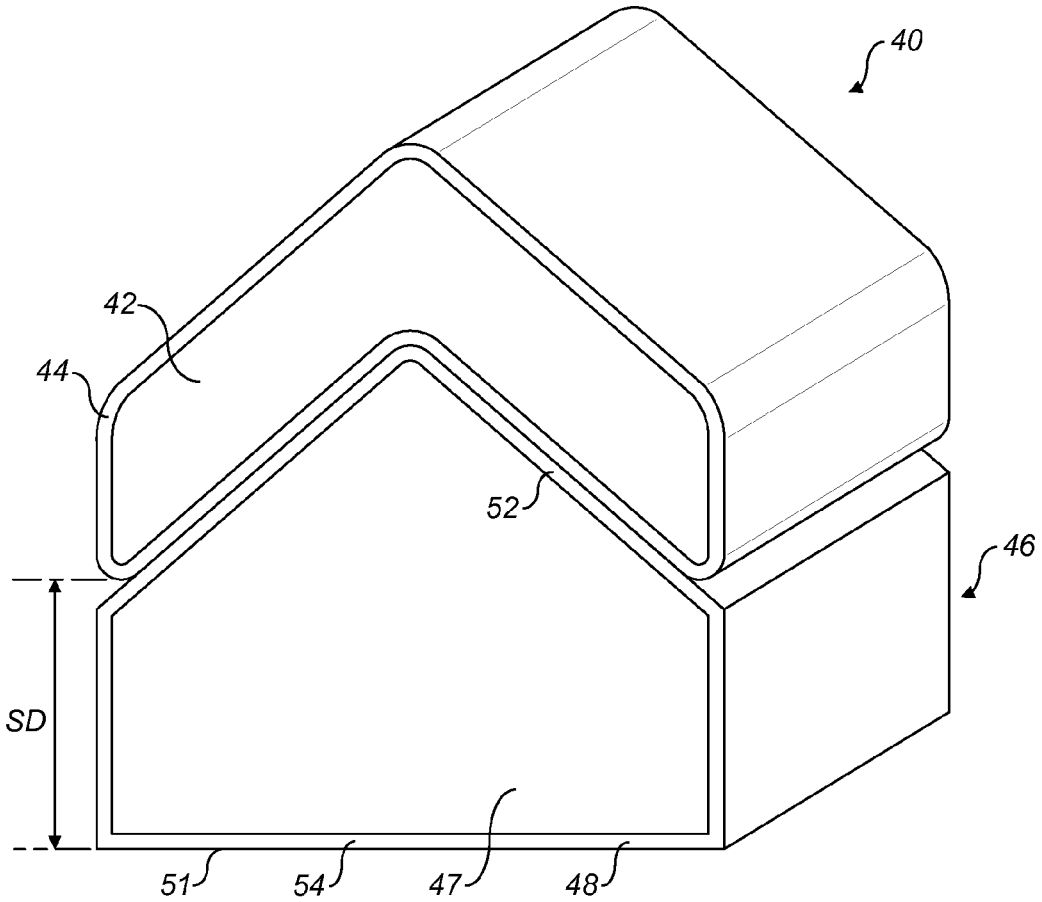
FIG. 5 shows schematically the element applied to the prior art linear shaped charge.

FIG. 5 shows schematically the element 46 applied to the liner of the linear shaped charge 40, i.e. the combined element 46 and charge 40.

The dimensions of the support member may be selected not only to co-operate with dimensions of the charge, to ensure a good fit between the element and the charge when combined, but also to define a desired stand-off distance SD between the liner and the surface 51 when applied to a target object. Further, the element may be arranged to fill substantially all of the space 45, for example, 50%, 75%, or greater than 90%, or for example 100%, of the space may be filled by the element 46.

The element 46 provides at least one film 52 between the liner and the face of the charge 40. In this example, a second film 54 of the at least one film is provided between the liner and the surface 51, as well as providing part of a film on the other longitudinal sides of the support member 47. Therefore, with the element arranged to fill substantially the space between the liner and the face, with the at least one film reducing deformation of the element at underwater pressures and with the at least one film being impervious to water, the entry of water into the space is prevented, or at least reduced. Thus, a prior art shaped charge may be modified to be provided with advantages of the present invention, for example improved underwater performance at greater depths, compared with the prior art charge not fitted with the element.

The element 46, more particularly a film of the at least one film, may be attached to the liner of the charge 40 using an adhesive, which may be a double sided adhesive tape. Alternatively, the combined element 46 and charge 40 may be held together by apparatus wrapped around the outer surfaces of the element and charge, for example a heat shrink wrapper or bands.

The surface 51 may be arranged for application to a target object, for example with a layer of adhesive such as a double-sided adhesive tape, thus allowing the combined element and charge to be attached to a target object.

For the embodiments described with reference to FIGS. 4 and 5 it is envisaged that the dimensions and shape of the element may be different from those described above, to fit with a desired shaped charge. The film may provide other properties to the charge. For example, the film may protect the liner, the casing and/or the material from other contaminants, such as a reactive gas or liquid, e.g. acid, and environmental factors such as heat, humidity, or physical knocks, which may damage the charge, interfere with performance of the cutting, and/or may contaminate or otherwise decrease the quality of the charge. It is further envisaged that other materials of the film may be used, beyond those described herein. Further, whilst the film and further film are described above as a coating on the casing and/or filling material, it is envisaged in other embodiments that the film may be formed of the material of the casing and/or filling material, for example by melting an outer surface of the casing/filling material or by causing the casing/filling material to form an outer film when formed against the inside of a mould, thus sealing the outer surface of the casing/filling material.

In further embodiments of the invention, the film may comprise granules, for example mineral granules of for example calcium carbonate, which may be dispersed uniformly throughout the film. The granules may be of a suitable diameter so that during application of the film the granules can be fitted inside open cells of an external surface of the foam material of the casing and/or filling material, which may be LDPE as described above. The cells may for example have a diameter of 0.2 milli-meters and the granules may have an average diameter of 0.1 milli-meters, meaning that more than 50% of the granules have a diameter of 0.1 milli-meters. The film material, for example the film compound described above, may for example be applied to the foam material under a pressure of between 1500 and 3000 psi. This forces the granules into the cells of the foam material. To ease the granules entering the open cells, the foam may be placed in a low pressure chamber, or autoclave, for example, to increase temporarily the diameter of the cells to accept the film, including the granules, when applying the film material to the foam. Upon return to atmospheric pressure the diameter of the cells decreases, and on drying/curing of the film compound, the granules are thus trapped inside the open cells of the foam, as part of the film; this mechanically attaches the film to the foam, thus giving adhesion of the film compound to the LDPE. Moreover, the granules enhance the resistance of the linear shaped charge to deformation by underwater pressures. Under such pressures the casing and/or filling material tends to compress, thus deforming the linear shaped charge and tending to pull the foam casing and/or filling material away from the liner, which can create voids which might fill with water and interfere with jet generation; as explained above, the film of the present invention counters such effects, by providing structural rigidity, thus reducing deformation of the linear shaped charge when underwater. In the embodiment with the film comprising granules, the film, when exposed to underwater pressures, tends to compress with the granules in the film being pushed closer to each other until they meet adjacent granules. At sufficient pressure, the granules of the film may therefore meet and abut multiple granules, thus forming a rigid film from the granules being locked against together; accordingly, the rigidity of the linear shaped charge may further be increased, as also is the resistance to deformation underwater pressures, for example at underwater pressures of 22 psi, compared with the embodiments described above where the film lacks the added mineral granules. Depending on the concentration and the homogeneity of dispersion of the granules in the film, the rigidity of the film, and therefore the level of pressure the linear shaped charge can withstand, may be controlled. In some embodiments the concentration and dispersion of the granules in the film is selected to provide a resistance to a desired level of underwater pressure, whilst maintaining a desired flexibility of the linear shaped charge along its longitudinal axis. It is envisaged that the granules may be a different mineral than calcium carbonate, or may be a non-mineral material, with suitable properties for forming a rigid film when subjected to underwater pressures in the manner described above. Further, it is envisaged that the size of cells of the filling/casing material may be different from 0.2 milli-meters and that, appropriately, the diameter of the granules may be different also from 0.1 milli-meters.

In embodiments described above, the filling material is coated with a continuous film. It is to be understood that further embodiments are envisaged where the at least one film comprises only the first film, for example covering the extent of the liner, or where the at least one film comprises only the second film, for example covering the extent of the face. Further embodiments are envisaged, different from those described, where the at least one film is between the liner and the face.

The thickness of the film may be different from that described above. A thicker film may be applied, to enhance structural support and underwater pressure resistance and water contamination. However, the film thickness needs to be selected to avoid detrimentally disrupting the cutting ability of the jet.

Embodiments of the present invention are described above relating to linear shaped charges. The providing of at least one film between a liner and a face of a shaped charge, described above, is not limited to a linear shaped charge. In a similar manner as described above for a linear shaped charge, at least one film may be provided between a liner and a face of other forms of shaped charge, for example a conical, parabolic, hemispherical and/or a progressive shaped charge.

Numerical ranges are given above. Although minimum and maximum values of such ranges are given, each numerical value between the minimum and maximum values, including rational numbers, should be understood to be explicitly disclosed herein. For example, a range of 45 to 60 kg $m^{-3}$ discloses also numerical values of for example 50, 53.4 and 58.75 kg $m^{-3}$.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A shaped charge comprising:

an explosive element, a face for application to a target object, a liner arranged for projection towards the face upon detonation of the explosive element, and a support member disposed between the liner and the face, the support member comprising a compressible core and an outer film, the outer film extending substantially along a length of the compressible core and surrounding the compressible core in cross section at least in the region of the liner, the outer film being configured to resist compression of the compressible core and maintain contact between the liner and the support member with the shaped charge submerged under water.

2. A shaped charge according to claim 1, wherein at least part of the outer film contacts the liner.

3. A shaped charge according to claim 1, wherein at least part of the outer film contacts the face.

4. A shaped charge according to claim 1, wherein the outer film comprises at least one of a compound comprising latex, bitumen and a surfactant; or a compound comprising an elastomeric membrane.

5. A shaped charge according to claim 1, wherein the shaped charge is one of a linear, conical, parabolic, hemispherical or a progressive shaped charge.

6. A shaped charge according to claim 5, comprising a casing surrounding at least part of the explosive element, wherein the casing is arranged to determine a distance between the liner and the face, the casing having at least one part for application to the target object.

7. A linear shaped charge according to claim 6, wherein at least part of the casing is coated with a further film.

8. A linear shaped charge according to claim 6, wherein the casing and the compressible core are integrally formed.

9. A linear shaped charge according to claim 6, wherein at least one of the casing or the compressible core has a density in the range of one of 15 to 60 kg $m^{-3}$, 25 to 60 kg $m^{-3}$, 35 to 60 kg $m^{-3}$, 45 to 60 kg $m^{-3}$, 50 to 60 kg $m^{-3}$ or 55 to 60 kg $m^{-3}$.

10. A linear shaped charge according to claim 6, wherein at least one of the casing or the compressible core comprises a low density polyethylene foam.

11. A linear shaped charge according to claim 1, wherein the linear shaped charge is flexible along a longitudinal axis.

12. A linear shaped charge according to claim 5, wherein the outer film comprises a coating disposed on longitudinal surfaces of the compressible core.

13. A shaped charge according to claim 1, wherein the outer film comprises granules selected from the group consisting of: mineral granules, non-mineral granules, granules with an average diameter of 0.1 milli-meters, calcium carbonate granules, and combinations thereof.

14. A shaped charge according to claim 1, wherein the outer film is configured to resist entry of water into the support member with the shaped charge submerged under water.

15. A shaped charge according to claim 1, wherein the outer film comprises granules engaged with openings in the compressible core.

16. A shaped charge according to claim 1, wherein the compressible core comprises foam.

17. A shaped charge according to claim 1, wherein the outer film surrounds at least a majority of the compressible core in cross section.

18. An element for a shaped charge, the shaped charge including an explosive element, a liner, and a face, the liner being arranged for projection towards the face upon detonation of the explosive element, the element comprising:

a support member adapted to be closely received by the liner, the support member comprising a compressible core and an outer film, the outer film extending substantially along a length of the compressible core and surrounding the compressible core in cross section at least in the region of the liner, the outer film being configured to resist compression of the compressible core and maintain contact between the liner and the support member with the shaped charge submerged under water.

19. An element according to claim 18, wherein the element has a shape configured to engage with a surface of the liner.

20. An element according to claim 18, further comprising an adhesive configured to attach the element to the liner.

21. An element according to claim 18, wherein the element is arranged for application to a target object.

22. An element according to claim 18, wherein the element is arranged to fill substantially all of a space between the liner and the face.

23. An element according to claim 18, wherein upon application of the element to the liner of the shaped charge, the element is arranged to define a stand-off distance between the liner and a target object.

24. An element according to claim 18, wherein the outer film includes granules selected from the group consisting of: mineral granules, non-mineral granules, granules with an average diameter of 0.1 milli-meters, calcium carbonate granules, and combinations thereof.

25. An element according to claim 18, wherein the outer film comprises at least one of a compound comprising latex, bitumen and a surfactant; or a compound comprising an elastomeric membrane.

26. An element according to claim 18, wherein the outer film comprises a coating disposed on longitudinal surfaces of the compressible core.

27. An element according to claim 18, wherein the outer film is configured to resist entry of water into the support member with the shaped charge submerged under water.

28. An element according to claim 18, wherein the outer film comprises granules engaged with openings in the compressible core.

29. An element according to claim 18, wherein the compressible core comprises foam.

30. An element according to claim 18, wherein the outer film surrounds at least a majority of the compressible core in cross section.

31. A method of modifying a shaped charge, the shaped charge including an explosive element, a liner, and a face for application to a target object, the liner being arranged for projection towards the face upon detonation of the explosive element, the method comprising:

providing a support member adapted to be closely received by the liner, the support member comprising a compressible core and an outer film, the outer film extending substantially along a length of the compressible core and surrounding the compressible core in cross section at least in the region of the liner, the outer film being configured to resist compression of the compressible core and maintain contact between the liner and the support member with the shaped charge submerged under water.

32. A method according to claim 31, further comprising:

applying an element to the liner of the shaped charge, the element including the support member.

33. A structure for assisting in cutting a target object with a liner configured to be propelled by an explosive element, the liner being arranged for projection toward the target object upon detonation of the explosive element, the structure comprising:

a support member adapted to be closely received by the liner, the support member comprising a compressible core and an outer film, the outer film extending substantially along a length of the compressible core and surrounding the compressible core in cross section at least in the region of the liner, the outer film being configured to resist compression of the compressible core and maintain contact between the liner and the support member with the structure submerged under water, the support member defining a face configured to be applied to the target object.

34. A structure according to claim 33, including an adhesive configured to attach the support member to the liner.

35. A structure according to claim 33, further comprising:

the liner; and the explosive element.

* * * * *